US005426800A

United States Patent [19]

St. John et al.

[11] Patent Number: 5,426,800

[45] Date of Patent: Jun. 27, 1995

[54] APPARATUS FOR STORING BEDSPREAD DURING SLEEPING HOURS

[76] Inventors: Judy M. St. John; Stanley L. St. John, both of 6028 Eugene Field Rd., Kansas City, Mo. 64119

[21] Appl. No.: 285,217

[22] Filed: Aug. 3, 1994

[51] Int. Cl.[6] ..... A47C 21/00

[52] U.S. Cl. ..... 5/504.1; 5/507.1

[58] Field of Search ..... 5/503.1–505.1, 5/507.1, 426

[56] References Cited

U.S. PATENT DOCUMENTS

| | | | |
|---|---|---|---|
| 2,618,789 | 11/1952 | Kane | 5/505.1 |
| 2,976,546 | 3/1961 | Owens | 5/504.1 |
| 3,317,932 | 5/1967 | Gibbons, Jr. | 5/505.1 |
| 4,022,502 | 5/1977 | Smith et al. | 5/426 |
| 4,214,527 | 7/1980 | Smith | 5/504.1 X |

FOREIGN PATENT DOCUMENTS

| | | | |
|---|---|---|---|
| 999265 | 1/1952 | France | 5/505.1 |

*Primary Examiner*—Michael F. Trettel

[57] ABSTRACT

An apparatus for storing a bedspread during sleeping hours comprising a pair of generally L-shaped members positionable in parallel relationship one with another, each L-shaped member having an elongated horizontal portion positionable between the box spring and mattress of a bed at the foot end thereof, each of the L-shaped members including a vertically extending short portion extending upwardly from the horizontal portion beyond the foot portion of the bed to define a space between the foot of the bed and the short portions; a plurality of cross slats, including at least one cross slat being positioned in a horizontal orientation upon the horizontal portions of the L-shaped member adjacent to the vertical section; and at least one vertically disposed cross slat positioned in association with the vertical portions of the L-shaped member, each of the slats being formed with a rectangular recess adjacent to the ends thereof cooperable with complimentary recesses in the L-shaped members, two in the vertical sections and two in the horizontal sections.

4 Claims, 4 Drawing Sheets

APPARATUS FOR STORING BEDSPREAD DURING SLEEPING HOURS

BACKGROUND OF THE INVENTION

1. Field of the Invention

The present invention relates to an apparatus for storing a bedspread during sleeping hours and more particularly pertains to supporting and storing a bedspread while a bed is being used.

2. Description of the Prior Art

The use of devices of various designs and configurations for supporting and or storing bedding, bedspreads and the like is known in the prior art. More specifically, devices of various designs and configurations for supporting and or storing bedding, bedspreads and the like heretofore devised and utilized for the purpose of supporting and/or storing bedspreads or other bedding through a wide variety of methods and/or apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,523,311 to Ricke a hospital bed footboard assembly.

U.S. Pat. No. 3,629,881 to Hinshaw discloses a bedrail footrest.

U.S. Pat. No. 3,523,310 to Shoets discloses a foot support for use by the occupant of a bed.

U.S. Pat. No. 3,638,250 to Johnson discloses a footrest structure for beds.

U.S. Pat. No. 3,639,929 to Ichise discloses a combination leg/foot rest and bed cover trainer.

In this respect, the apparatus for storing a bedspread during sleeping hours according to the present invention substantially departs from the conventional concepts and designs of the prior art, and in so doing provides an apparatus primarily developed for the purpose of supporting and storing a bedspread while a bed is being used.

Therefore, it can be appreciated that there exists a continuing need for a new and improved apparatus for storing a bedspread during sleeping hours which can be used for supporting and storing a bedspread while a bed is being used. In this regard, the present invention substantially fulfills this need.

SUMMARY OF THE INVENTION

In view of the foregoing disadvantages inherent in the known types of devices of various designs and configurations for supporting and or storing bedding, bedspreads and the like now present in the prior art, the present invention provides an improved apparatus for storing a bedspread during sleeping hours. As such, the general purpose of the present invention, which will be described subsequently in greater detail, is to provide a new and improved apparatus for storing a bedspread during sleeping hours and method which has all the advantages of the prior art and none of the disadvantages.

To attain this, the present invention essentially comprises a new and improved apparatus for storing a bedspread during sleeping hours comprising, in combination, a pair of generally L-shaped members positionable in parallel relationship one with another, each L-shaped member having an elongated horizontal portion positionable between the box spring and mattress of a bed at the foot end thereof, each of the L-shaped members including a vertically extending short portion extending upwardly from the horizontal portion beyond the foot portion of the bed to define a space between the foot of the bed and the short portions; a plurality of cross slats, two of the cross slats being positioned in a horizontal orientation upon the horizontal portions of the L-shaped member adjacent to the vertical section; a plurality of vertically disposed cross slats positioned in association with the vertical portions of the L-shaped member, each of the slats being formed with a rectangular recess adjacent to the ends thereof cooperable with complimentary recesses in the L-shaped members, two in the vertical sections and two in the horizontal sections; and removable coupling components for joining the L-shaped members to the cross slats through apertures extending therethrough in the regions of the recess, the L-shaped members and cross slats being fabricated of a rigid lightweight plastic material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for storing a bedspread during sleeping hours which has all the advantages of the prior art devices of various designs and configurations for supporting and or storing bedding, bedspreads and the likes and none of the disadvantages.

It is another object of the present invention to provide a new and improved apparatus for storing a bedspread during sleeping hours which may be easily and efficiently manufactured and marketed.

It is a further object of the present invention to provide a new and improved apparatus for storing a bedspread during sleeping hours which is of a durable and reliable construction.

An even further object of the present invention is to provide a new and improved apparatus for storing a bedspread during sleeping hours which is susceptible of a low cost of manufacture with regard to both materials and labor, and which accordingly is then susceptible of low prices of sale to the consuming public, thereby making such devices of various designs and configurations for supporting and or storing bedding, bedspreads and the likes economically available to the buying public.

Still yet another object of the present invention is to provide a new and improved apparatus for storing a bedspread during sleeping hours which provides in the apparatuses and methods of the prior art some of the advantages thereof, while simultaneously overcoming some of the disadvantages normally associated therewith.

Still another object of the present invention is to support and store a bedspread while a bed is being used.

Lastly, it is an object of the present invention to provide a new and improved apparatus for storing a bedspread during sleeping hours comprising a pair of generally L-shaped members positionable in parallel relationship one with another, each L-shaped member having an elongated horizontal portion positionable between the box spring and mattress of a bed at the foot end thereof, each of the L-shaped members including a vertically extending short portion extending upwardly from the horizontal portion beyond the foot portion of the bed to define a space between the foot of the bed and the short portions; a plurality of cross slats, including at least one cross slat being positioned in a horizontal orientation upon the horizontal portions of the L-shaped member adjacent to the vertical section; and at least one vertically disposed cross slat positioned in association with the vertical portions of the L-shaped member, each of the slats being formed with a rectangular recess adjacent to the ends thereof cooperable with complimentary recesses in the L-shaped members, two in the vertical sections and two in the horizontal sections.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part throughout the various figures.

DESCRIPTION OF THE PREFERRED EMBODIMENT

Figure 1:
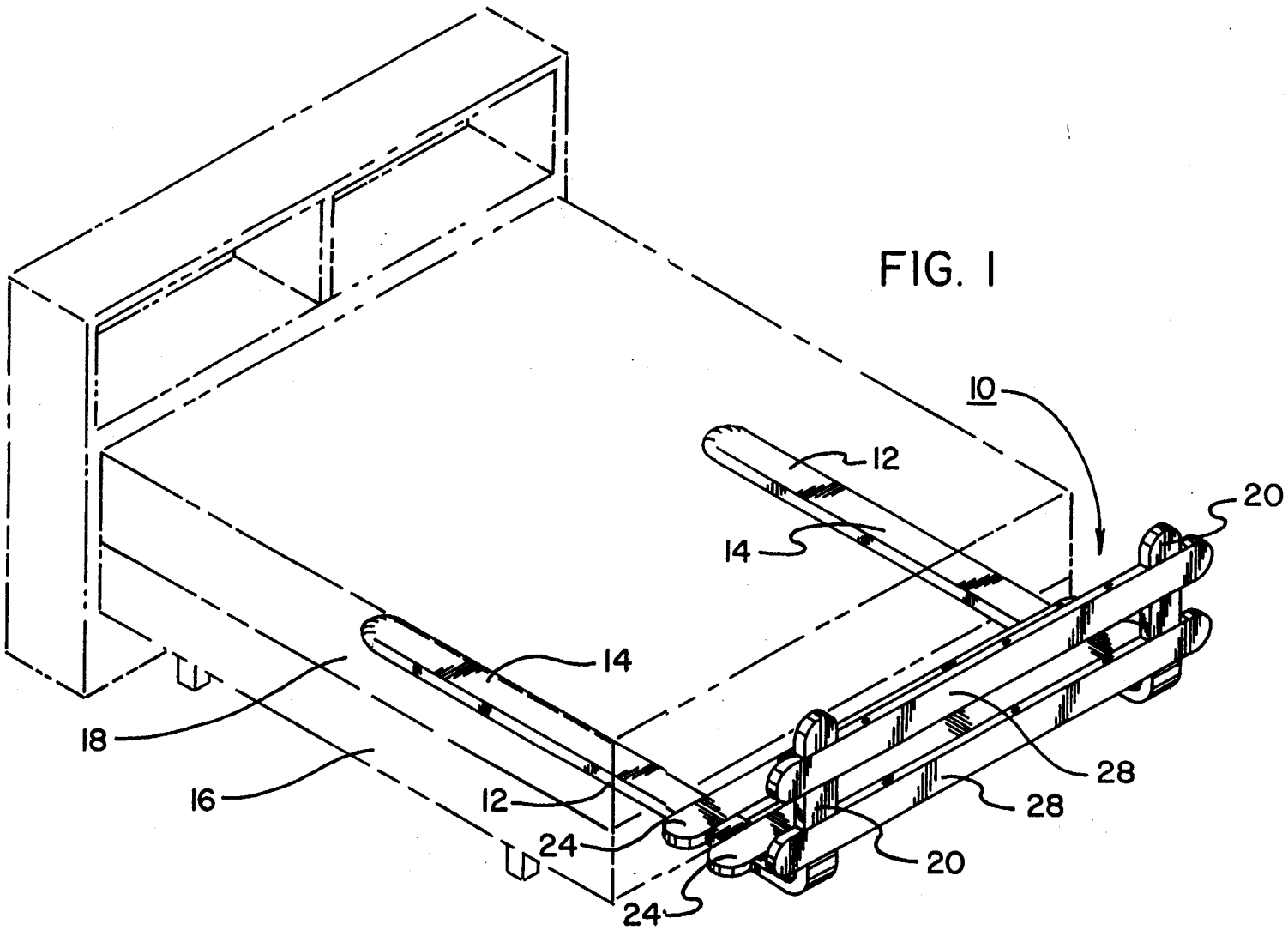
FIG. 1 is a perspective illustration of the preferred embodiment of the new and improved apparatus for storing bedspread during sleeping hours constructed in accordance with the principles of the present invention.

With reference now to the drawings, and in particular to FIG. 1 thereof, a new and improved apparatus for storing a bedspread during sleeping hours embodying the principles and concepts of the present invention and generally designated by the reference numeral 10 will be described.

The present invention is a system 10 comprised of a plurality of component elements. Such component elements include, in their broadest context, a pair of L-shaped members, horizontal cross slats, vertical cross slats and removable coupling components including end caps.

More specifically, the invention has as its central component a pair of generally L-shaped members 12. Such L-shaped members are positionable in parallel relationship in a common plane one with respect to the other. Each L-shaped member has an elongated horizontal portion 14. Such horizontal portion is positionable between the box spring 16 and mattress 18 of a bed. Note FIGS. 1 and 2. Its positioning is at the foot end of a bed.

Figure 2:
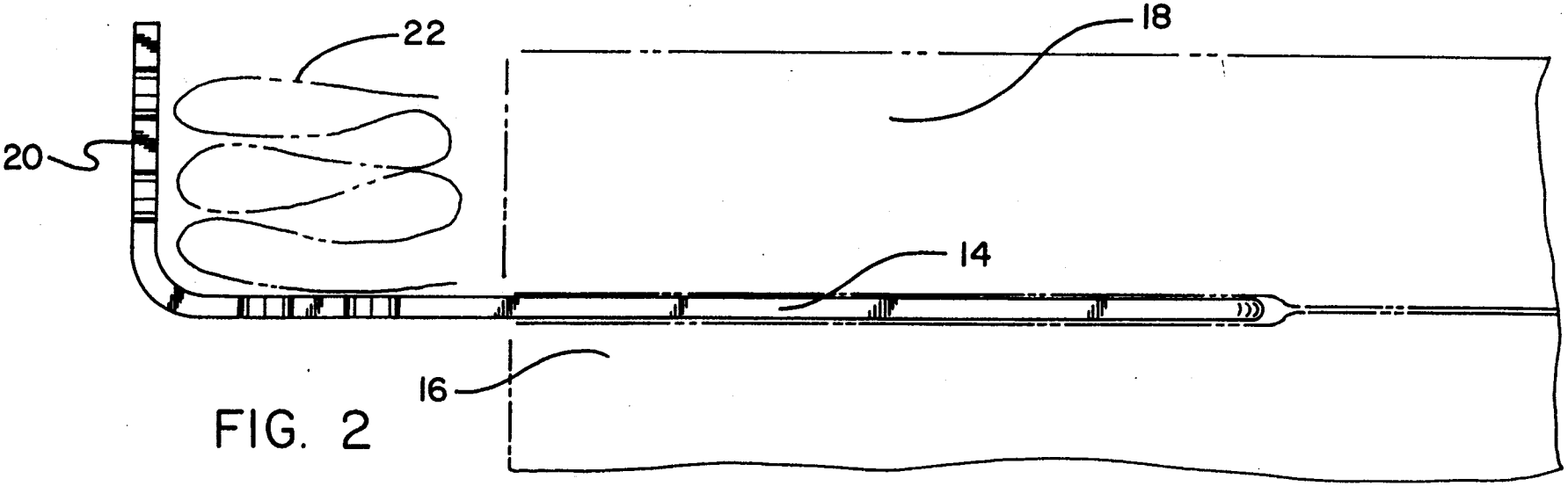
FIG. 2 is a side elevational view of the device shown in FIG. 1.
Figure 3:
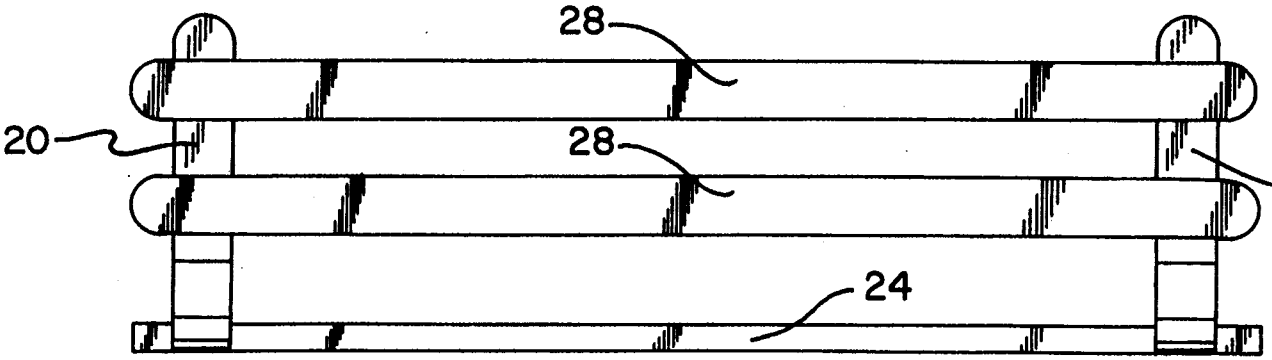
FIG. 3 is an end elevational view of the device shown in FIGS. 1 and 2.
Figure 4:
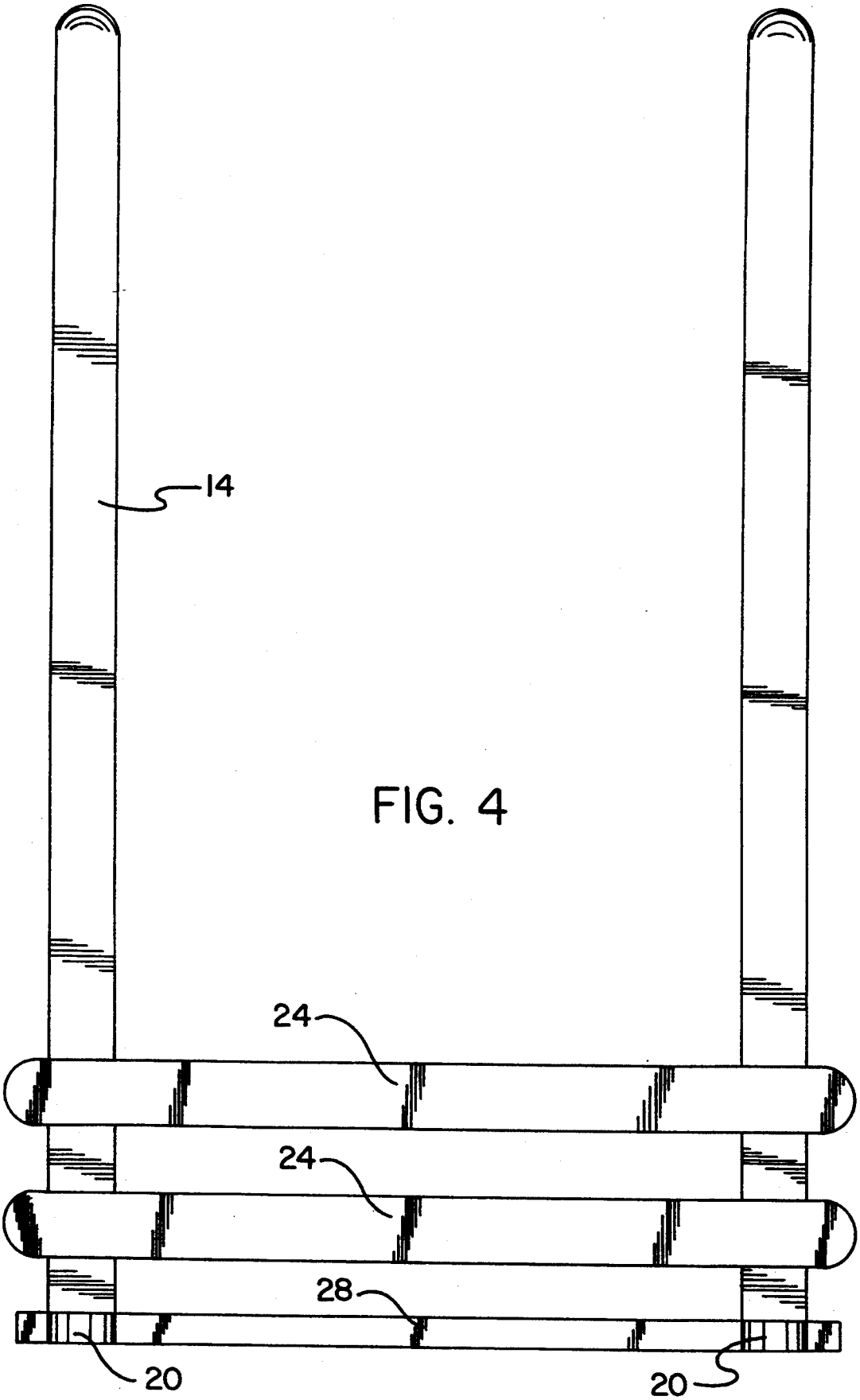
FIG. 4 is a top elevational view of the device shown in the prior Figures.

Each of the L-shaped members includes a vertically extending short portion 20 at the outboard end of the horizontal portion. The short portion extends upwardly from the horizontal portion beyond the foot portion of the bed. In this manner, a space is defined between the foot of the bed and the short portions. Note the bedding 22 stacked in the storage position as shown in FIG. 2.

Next provided are a plurality of cross slats. Two of the cross slats 24 are positioned in a horizontal orientation upon the horizontal portions of the L-shaped member. These are located adjacent to the vertical section of the L-shaped member.

In addition, the plurality of slats include a plurality, preferably two, vertically disposed cross slats 28. Such vertical cross slats are positioned in association with the vertical portions of the L-shaped member.

Each of the slats is formed with a rectangular recess 32. Such recesses are adjacent to the ends thereof near the joinder of the horizontal and vertical portions of the L-shaped member. Such rectangular recesses are cooperable with complimentary recesses 34 formed in the L-shaped members. Such complimentary recesses have two in the vertical sections and two in the horizontal sections.

Next provided are removable coupling components 38 in the form of threaded bolts. Such coupling components are for joining the L-shaped members to the cross slats. The coupling is through apertures 40 and 42 extending through the L-shaped members and cross slats at symmetrically located orientations. The apertures extend through the L-shape members and cross slats in the regions of the recesses.

Figure 5:
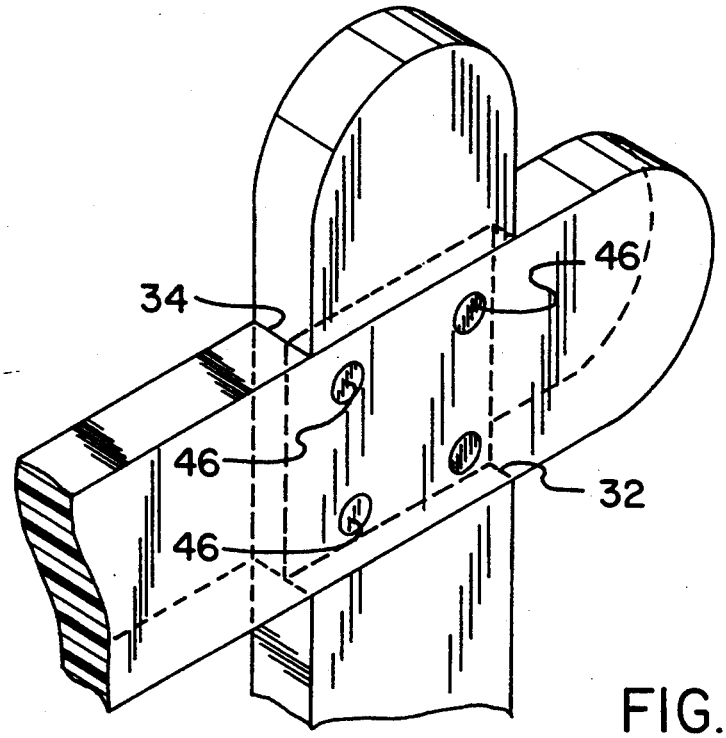
FIG. 5 is an enlarged perspective view of one corner of the coupling components shown in the prior Figure.
Figure 6:
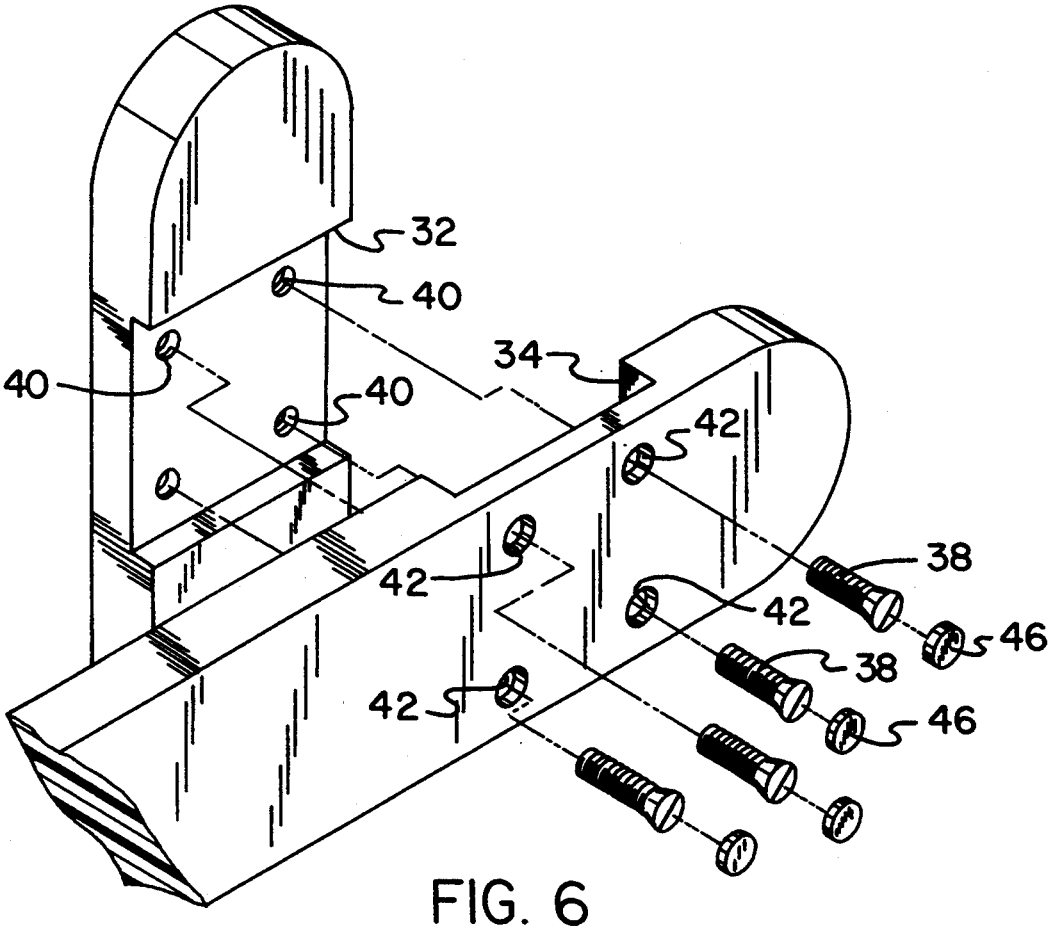
FIG. 6 is an exploded perspective view of the apparatus shown in FIG. 5.

The last component of the system is a plurality of end caps 46. Note FIGS. 5 and 6. The end caps are simply cylindrical disks positionable in the recesses of the cross slats to cover the ends of the bolts for aesthetic purposes.

In the preferred embodiment, the L-shaped members and cross slats are fabricated of a rigid lightweight plastic material. Such material may be colored as desired for aesthetic purposes.

The present invention is designed to serve as a convenient storage area for a bedspread during sleeping hours. Further, though it remains in place ready for use, it essentially "disappears" when the bed is made during daytime hours. It is simply comprised of two, three or four L-shaped slats, i.e., two slats are used for a twin sized bed, three for a full sized bed and four for the queen and king sized versions. The longer leg of these slats is forty-eight inches in length while the other is six and one-half inches long.

Two slightly spaced straight slats, which are forty inches in length, are affixed to the longer legs of the L-shaped members just inside the interior intersection of the two legs, and the additional two similar slats are mounted across the outboard faces of the shorter legs. The outboard L-shaped members are spaced at a distance which is slightly shorter than the width of the mattress. All of these components are made of rigid lightweight plastic.

From the foregoing description, the use of the present invention becomes fairly obvious. The extensions of the two L-shaped slats are simply slipped between the mattress and the box spring at the foot of the bed with the shorter legs pointing upward and in a vertical attitude. Once in this position, the assembly may be partially pulled out of the way and entirely off the top surface of the mattress. When not in use for this purpose, it can be pushed in so that the short legs abut the bottom vertical surface of the mattress, and when the bed is made, it will be out of sight.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for storing a bedspread during sleeping hours comprising, in combination:

a pair of generally L-shaped members positionable in parallel relationship one with another, each L-shaped member having an elongated horizontal portion positionable between the box spring and mattress of a bed at the foot end thereof, each of the L-shaped members including a vertically extending short portion extending upwardly from the horizontal portion beyond the foot portion of the bed to define a space between the foot of the bed and the short portions;

a plurality of cross slats, two of the cross slats being positioned in a horizontal orientation upon the horizontal portions of the L-shaped member adjacent to the vertical section;

a plurality of vertically disposed cross slats positioned in association with the vertical portions of the L-shaped member, each of the slats being formed with a rectangular recess adjacent to the ends thereof cooperable with complimentary recesses in the L-shaped members, two in the vertical sections and two in the horizontal sections; and removable coupling components for joining the L-shaped members to the cross slats through apertures extending therethrough in the regions of the recess, the L-shaped members and cross slats being fabricated of a rigid lightweight plastic material.

2. An apparatus for storing a bedspread during sleeping hours comprising:

a pair of generally L-shaped members positionable in parallel relationship one with another, each L-shaped member having an elongated horizontal portion positionable between the box spring and mattress of a bed at the foot end thereof, each of the L-shaped members including a vertically extending short portion extending upwardly from the horizontal portion beyond the foot portion of the bed to define a space between the foot of the bed and the short portions;

a plurality of cross slats, including at least one cross slat being positioned in a horizontal orientation upon the horizontal portions of the L-shaped member adjacent to the vertical section; and at least one vertically disposed cross slat positioned in association with the vertical portions of the L-shaped member, each of the slats being formed with a rectangular recess adjacent to the ends thereof cooperable with complimentary recesses in the L-shaped members, two in the vertical sections and two in the horizontal sections.

3. The apparatus as set forth in claim 2 and further including:

removable coupling components for joining the L-shaped members to the cross slats through apertures extending therethrough in the regions of the recess, the L-shaped members and cross slats being fabricated of a rigid lightweight plastic material.

4. The apparatus as set forth in claim 2 and further including caps shielding the ends of the attachment means in the associated apertures.

* * * * *